US005303784A

United States Patent [19]

Awdujewski et al.

[11] Patent Number: 5,303,784

[45] Date of Patent: Apr. 19, 1994

[54] DRILLING APPARATUS

[75] Inventors: Wsewolod S. Awdujewski; Rifner W. Ganijew, both of Moskau; Robert S. Mufasalow, BaSSR; Jurij P. Sacharow, Moskau, all of U.S.S.R.

[73] Assignee: Wave Tec Ges.m.b.H., Laxenburg, Austria

[21] Appl. No.: 878,474

[22] Filed: May 5, 1992

[30] Foreign Application Priority Data

May 6, 1991 [SU] U.S.S.R. ..... 4928471

[51] Int. Cl.[5] ..... E21B 7/24

[52] U.S. Cl. ..... 175/56; 175/340; 175/424

[58] Field of Search ..... 175/1, 56, 339, 340, 175/393, 424

[56] References Cited

U.S. PATENT DOCUMENTS 3,105,560 10/1963 Zublin ..... 175/56
3,415,330 12/1968 Bouyoucos ..... 175/56
3,416,487 12/1968 Greene ..... 175/56
3,441,094 4/1969 Galle et al. ..... 175/56
3,532,174 10/1970 Diamantides ..... 175/56
3,610,347 10/1971 Diamantides ..... 175/56
4,475,603 10/1984 Hayatdavoudi ..... 175/65
4,512,420 4/1985 Hayatdavoudi et al. ..... 175/340 X
4,687,066 4/1990 Evans ..... 175/340

FOREIGN PATENT DOCUMENTS 2224054 4/1990 United Kingdom .

*Primary Examiner*—Ramon S. Britts
*Assistant Examiner*—Roger J. Schoeppel
*Attorney, Agent, or Firm*—Rothwell, Figg, Ernst & Kurz

[57] ABSTRACT

The drilling apparatus according to the invention contains a body (1) to which rock-destroying organs—rollers (2) are attached. A subassembly for generating hydrodynamic waves is arranged in the body (1). This subassembly is designed in the form of a turbulence chamber (3) with tangentially arranged entry channels (4) and with a conically tapering outlet channel (5) the frontal surface of which is radially rounded off.

4 Claims, 2 Drawing Sheets

DRILLING APPARATUS

TECHNICAL FIELD

The present invention refers to a rock-destroying drilling tool and in particular to a drilling bit.

BACKGROUND OF THE INVENTION

There is a familiar drilling apparatus that contains a hollow body with rock-destroying components —rollers —attached to it. A replaceable cylinder is arranged in the body and is fixed by pins to the body. A transition piece to the bit is attached to the body by a screw-coupling. Inside this transition piece and axially to the body is housed a sliding case with a subassembly for generating hydrodynamic waves, with lateral channels and a central channel. Fixtures that are resistant to wear are mounted in the channels. The transition piece to the bit has an inner flange that serves as support for a spring that embraces the case and works with the flared flange of the case.

After the drilling apparatus is inserted into a drill hole, flushing first takes place through the central channel of the sliding case. In the process, a force determined by a pressure difference at the fixture arranged in the central channel acts upon the flared flange of the case. The spring is compressed by the action of this force until the lateral channels come to rest under the frontal surface of the cylinder. The lateral channels open in the process and liquid pressure in the case drops enough for the spring to bring the case back upward until these channels are covered, and the cycle repeats itself. When the case moves downward the flushing liquid situated in the space between the case and the transition piece to the bit is expelled upward through overflow openings.

The frequency of the pendulum movements of the case can be adjusted by the pumping capacity and the cross-sectional surface of hydromonitor attachments.

Known drilling apparatuses are inadequate for current demands on drilling technology and do not ensure the sinking of a drill hole for the following reasons:

- the generated hydrodynamic pulsations of the drill liquid do not contribute to destroying the rock due to their low frequency and slight amplitude and do not ensure an increase in drilling characteristics—mechanical speed and bit base length;
- the complexity of construction from the perspective of production and assembly increases production costs;
- the presence of movable subassemblies and elements in the construction does not guarantee the required service life and reliability, in particular in an abrasive medium of drill liquid.

DISCLOSURE OF THE INVENTION

The invention is based on the task of creating a drilling apparatus wherein the subassembly for generating hydrodynamic waves is designed in such a way that by generating a turbulent stream of drill liquid, it enables one to make use of the high level of energy of the directed effect of the hydrodynamic waves created by the stream of liquid with a broad frequency range in the zone near the drill hole and to create a partial vacuum in this zone.

The task thus presented is solved by a drilling apparatus which contains a body with attached rock-destroying components and with a subassembly arranged inside it to create hydrodynamic waves. In this drilling apparatus, according to the invention, the subassembly for generating hydrodynamic waves is designed in the form of a turbulence chamber with tangentially arranged entry channels and an outlet channel that tapers conically with a rounded frontal surface.

This is determined by the need to generate hydroacoustic waves to activate the rock destruction process. The turbulence chambers constitute strong hydrodynamic wave radiators with a broad frequency spectrum. In addition, the turbulence chambers create a partial vacuum in the zone near the drill hole, which promotes the destruction process and a cleaning of the floor. The narrowing of the outlet channel of the turbulence chamber is due to the fact that when the channel diameter decreases, the rotation frequency of the liquid decreases proportionally to the turbulence chamber diameter-outlet pipe diameter ratio, and the frequency of wave emission accordingly increases.

The frontal surface of the outlet channel is designed radially rounding off due to the need to keep hydraulic losses low when steering the drill liquid into the torus, and this also improves the efficiency of the vacuum in the zone near the drill hole.

It is useful to design the cavity of the turbulence chamber in spherical shape.

The choice of a spherical shape for the turbulence chamber is due to the high amplitude of the waves generated by spherical radiators working in self-oscillation operation with a periodical hydraulic self-blocking of the outlet channel.

It is preferable for the turbulence chamber to be equipped with a conical wave reflector arranged in its upper part in the direction of its longitudinal axis, and for the angle of inclination of the generatrices of the conical surface of the reflector to be below the critical value of the angle of approach of a wave coming in to the conical surface.

Equipping the turbulence chamber with the conical wave reflector makes it possible to prevent hydroacoustic and cavitation wear on the central part of the chamber head and to increase the service life of the drilling apparatus.

The angle of inclination X for the generatrices of the conical surface of the wave reflector must not be greater than the critical value $\theta'$, of the angle of approach of the incident acoustic wave because the boundary surface of the two media (flushing liquid and metal) with different density and compressibility levels constitutes a reflective, absorptive, breaking surface. If the angle of approach $\theta'$ of the incident wave is not greater than the critical angle of approach $\theta'$, i.e., $\theta' < 0'$, then a total reflection takes place. Such a wave does not transfer any energy from the first medium (flushing liquid) into the second medium (metal), and therefore the total energy of the incident wave is reflected back to the first medium. An angle between the wave propagation direction and the boundary surface is designated for the angle of approach. The cosine of the critical angle of approach 0' is equal to the refractive index of the second medium with respect to the first (Snell's law), i.e., $$\cos \theta' = n = c/c/c_1,$$

where c is the acoustic velocity in the flushing liquid;

$c_1$ is the acoustic velocity in the metal;

n is the refractive index.

It is advantageous to provide the subassembly for generating hydrodynamic waves with a resonance chamber the cavity of which is connected to the cavity of the turbulence chamber and which houses a piston with a rod with the ability to shift in longitudinal direction.

This is based on the need to tune the generated waves to a resonance frequency for various flow quantities and densities of the drilling liquid. Tuning to the resonance frequency is done by shifting the piston by means of a worm rod and by changing the volume of the resonance chamber under the piston.

The drilling apparatus designed according to the invention ensures highly effective sinking of the drill hole. In addition, it allows wave colmation of the drill hole wall when passing through geologically complicated horizons (in areas with caving or absorption, and in the case of water, petroleum or natural gas egress). Using the drilling apparatus referred to in the patent application also allows one to substantially increase the mechanical drilling speed and the bit base length.

BRIEF DESCRIPTION OF THE DRAWINGS

The present invention is explained in greater detail below in a concrete form of construction with the attached drawings. Shown are.

OPTIMAL FORM OF CONSTRUCTION OF THE INVENTION

Figure 1:
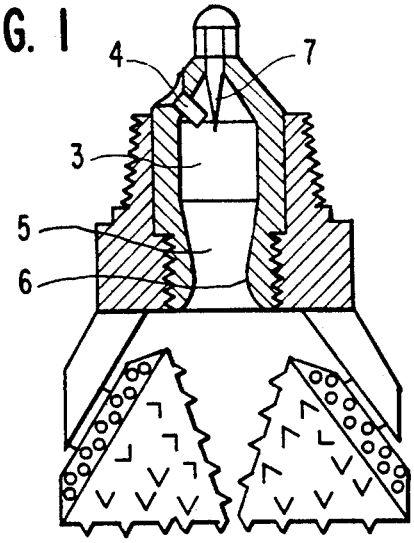
FIG. 1: the complete view of a drilling apparatus according to the invention.
Figure 2:
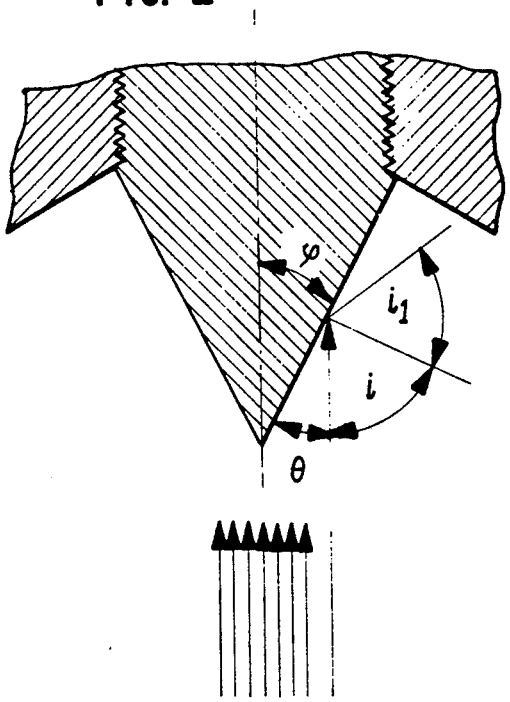
FIG. 2: a conical wave reflector according to the invention.

The drilling apparatus according to the invention contains a body 1 (FIG. 3) with attached rock-destroying components—rollers 2. A subassembly for generating hydrodynamic waves is arranged in the body 1. This subassembly constitutes a turbulence chamber 3 with tangentially running entry channels 4. The turbulence chamber 3 has an outlet channel 5 that tapers quite conically. The frontal surface 6 of this channel 5 is designed radially rounded off. The turbulence chamber 3 is equipped with a conical wave reflector 7 (FIGS. 1, 2). The purpose of the conical reflector 7 is to prevent wear on the head of the turbulence chamber 3 from the action of hydroacoustic and hydraulic impact waves, high frequency waves and ultrasonic waves. It acts as a hydroacoustic wave concentrator.

Figure 3:
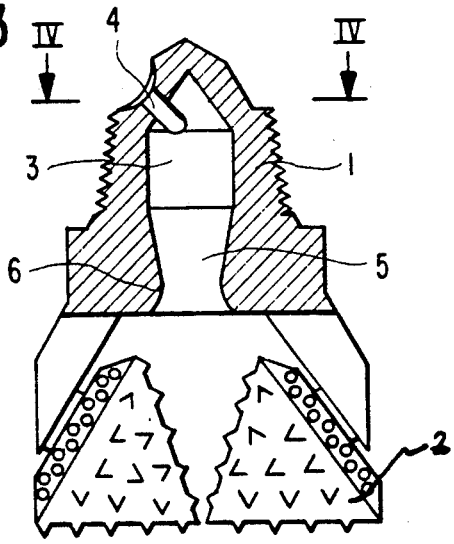
FIG. 3: the complete view of the drilling apparatus according to the invention, with a turbulence chamber designed in the body of the bit.
Figure 4:
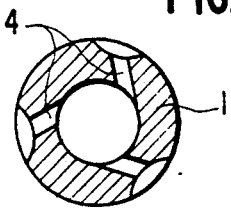
FIG. 4: a cross-section according to FIG. 2.
Figure 5:
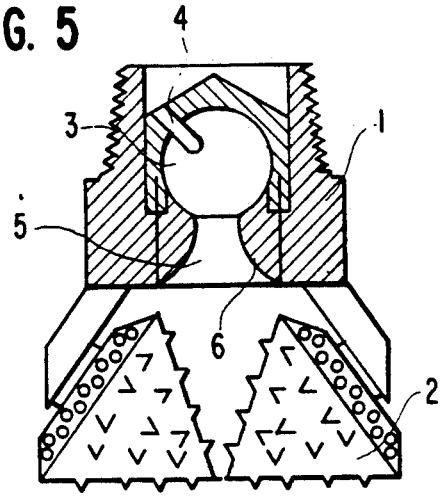
FIG. 5: the complete view of the drilling apparatus according to the invention with a turbulence chamber.

The body 1 of the drilling apparatus 1 can also serve as the body of the turbulence chamber 3 (FIGS. 3, 4).

Figure 6:
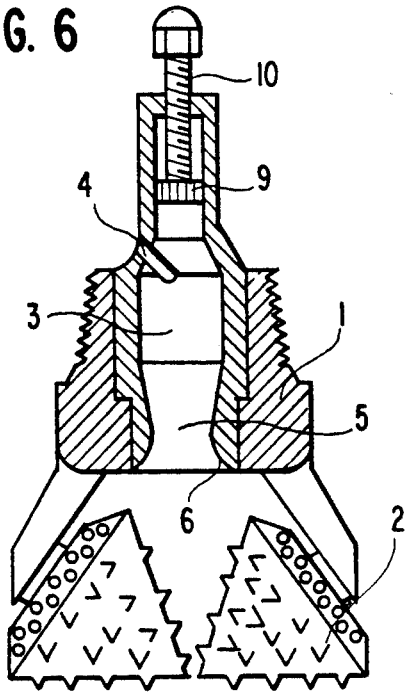
FIG. 6: the complete view of the drilling apparatus according to the invention with a resonance chamber.

To increase the amplitude of the generated waves and the effectiveness of the rock-destruction, the turbulence chamber 3 (FIG. 6) can be equipped with a resonance chamber 8 housing a piston 9 with a rod 10. The volume of the chamber 8 under the piston is changed by screwing or unscrewing the rod 1.

Figure 7:
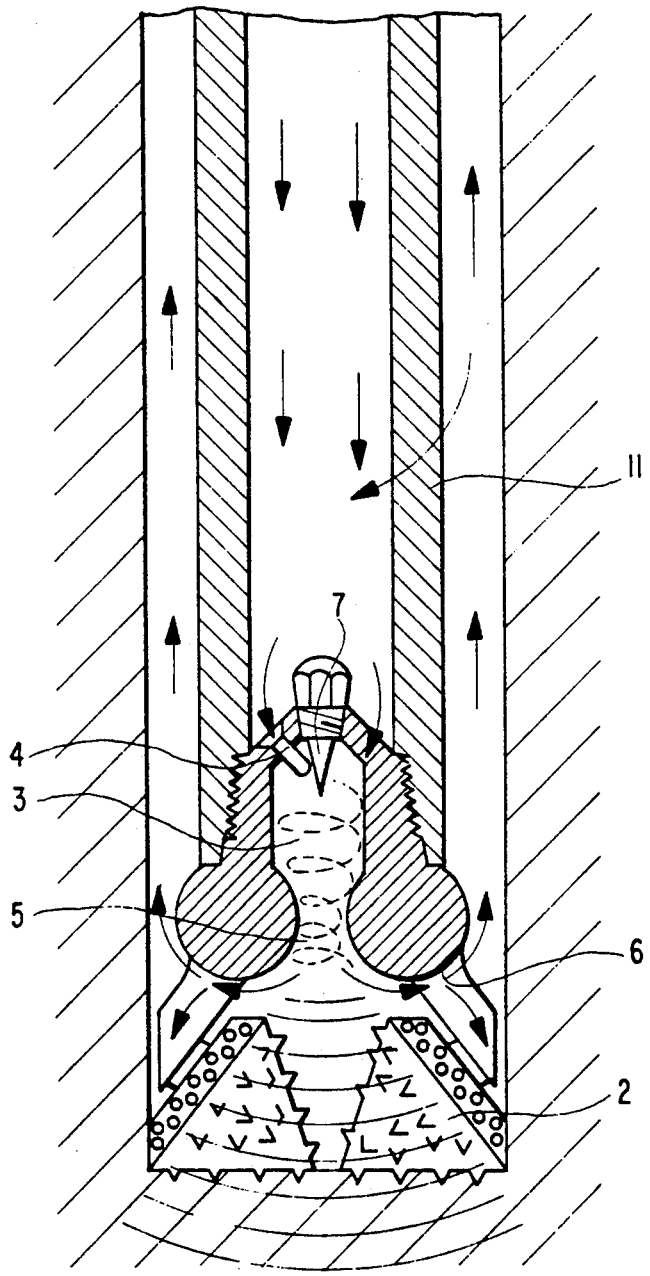
FIG. 7: a sketch to demonstrate the work of the drilling apparatus according to the invention in a drill hole.

The drilling apparatus works as follows. The drill liquid is conveyed through a drill column 11 (FIG. 7) into the tangentially oriented entry channel 4. The drill liquid then flows through the tangential channel 4 into the turbulence chamber 3. In the turbulence chamber 3 the drill liquid is made to rotate and directed through the outlet channel 5 into the torus.

As a result of the narrowing of the outlet channel 5, the intensity of the rotation of the drill liquid increases suddenly at the exit of the outlet channel. The drill liquid is steered in radially diverging directions into the torus by the kinetic energy of the turbulent current. In the process, a partial vacuum is created in the turbulence chamber 3 and in the central zone of the floor. Owing to a periodical break-through of the drill liquid from the zone near the drill hole into the turbulence chamber 3, powerful hydrodynamic pulsations of the self-oscillation type are created in the zone near the drill hole. The amplitude and frequency of the generated waves depend on the geometric parameters of the turbulence chamber 3, the pressure difference in the installation, and the density and quantity of the liquid to be pumped through.

The hydroacoustic waves generated by the subassembly are propagated mainly in two directions: inward in the turbulence chamber 3 and to the floor or the drill hole. The hydroacoustic waves directed inward are absorbed by the conical wave reflector 7 and totally reflected and scattered by its conical surface without having had any destructive effect on the head of the turbulence chamber 3. In this way, operating safety and service life of the apparatus are increased, while the hydroacoustic waves directed to the floor of the drill hole intensively destroy the central part of floor of the drill hole and are more effective in many types of rock than a dentiform mechanical rock-destruction.

The use of the drilling apparatus referred to in the patent application makes it possible to substantially increase the mechanical drilling speed and the bit base length compared to the prototypes and the best drilling apparatuses that can be used.

The effectiveness is obtained by creating a high level of wave energy with a directed effect in the zone near the drill hole. Furthermore, the present apparatus allows for wave colmation of the drill hole wall when passing through geologically complicated horizons (in areas with caving or absorption, and in the case of water, petroleum or natural gas egress).

INDUSTRIAL APPLICATION

The invention can be used in the sinking of drill holes using rock-destroying organs of the roller type.

We claim:

1. Drilling apparatus, comprising:

a body with attached rock-destroying components;

a subassembly arranged within said body for generating hydrodynamic waves of varying intensity of fluid flow velocity in a fluid along a flow path outward thereof, said subassembly including a turbulence chamber having substantially tangentially arranged entry channels for entry of fluid into a cavity thereof, and a conically tapered outlet channel with a rounded-off frontal surface for directing said hydrodynamic waves onto said rock-destroying components, and a conical wave reflector arranged within an upper part of said turbulence chamber substantially in the direction of a longitudinal axis thereof, wherein the angle of inclination $\alpha$ of the generatrices of the conical surface of the wave reflector is below the critical value $\theta'$ of the angle of approach $\theta$ of a wave coming into the conical surface of the wave reflector.

2. Drilling apparatus according to claim 1, wherein the cavity of said turbulence chamber is designed in a spherical shape.

3. Drilling apparatus, comprising:

a body with attached rock-destroying components;

a subassembly arranged within said body for generating hydrodynamic waves of varying intensity of fluid flow velocity in a fluid along a flow path outward thereof, said subassembly including a turbulence chamber having substantially tangentially arranged entry channels for entry of fluid into a cavity thereof, and a conically tapered outlet channel with a rounded-off frontal surface for directing said hydrodynamic waves onto said rock-destroying components, and a resonance chamber having a cavity coupled to the cavity of said turbulence chamber and housing a piston selectively movable along a longitudinal direction thereof.

4. Drilling apparatus according to claim 3, wherein the cavity of said turbulence chamber is designed in a spherical shape.

* * * * *

UNITED STATES PATENT AND TRADEMARK OFFICE

CERTIFICATE OF CORRECTION

PATENT NO. : 5,303,784

DATED : April 19, 1994

INVENTOR(S) : Wsewolod S. Awdujewski et al.

It is certified that error appears in the above-indentified patent and that said Letters Patent is hereby corrected as shown below:

Col. 2, line 45, "X" should be -- $\varphi$ --; Col. 2, line 47, delete the comma; Col. 2, line 52, "$\theta'$" should be -- $\theta$ --; Col. 2, line 54, " $\theta' < 0'$" should be -- $\theta < \theta'$ --; Col. 5, line 1, "$\alpha$" should be -- $\varphi$ --.

Signed and Sealed this

Twenty-third Day of August, 1994

*Attest:*

Bruce Lehman

BRUCE LEHMAN

*Attesting Officer*

*Commissioner of Patents and Trademarks*